US006757934B2

(12) United States Patent
Park

(10) Patent No.: US 6,757,934 B2
(45) Date of Patent: Jul. 6, 2004

(54) SUCTION HEAD FOR VACUUM CLEANER

(75) Inventor: Jin Soo Park, Incheon (KR)

(73) Assignee: LG Electronics, Inc., Seoul (KR)

( * ) Notice: Subject to any disclaimer, the term of this patent is extended or adjusted under 35 U.S.C. 154(b) by 213 days.

(21) Appl. No.: 10/044,919

(22) Filed: Jan. 15, 2002

(65) Prior Publication Data

US 2003/0037408 A1 Feb. 27, 2003

(30) Foreign Application Priority Data

Aug. 27, 2001 (KR) ..... 2001-51851

(51) Int. Cl.[7] ..... A47L 9/04
(52) U.S. Cl. ..... 15/377; 15/389
(58) Field of Search ..... 15/377, 380, 383, 15/389, 392

(56) References Cited

U.S. PATENT DOCUMENTS

| | | | | | |
|---|---|---|---|---|---|
| 1,953,340 | A | * | 4/1934 | Doemling | 15/389 |
| 4,268,769 | A | * | 5/1981 | Dorner et al. | 310/67 R |
| 6,314,611 | B1 | * | 11/2001 | Sauers | 15/376 |
| 6,323,570 | B1 | * | 11/2001 | Nishimura et al. | 310/67 R |
| 6,463,623 | B2 | * | 10/2002 | Ahn et al. | 15/389 |

FOREIGN PATENT DOCUMENTS

| | | | |
|---|---|---|---|
| EP | WO 93/11695 A1 | | 6/1993 |
| GB | 2333443 A | | 7/1999 |
| JP | 54-118659 | * | 9/1979 |
| JP | 110042184 A | | 12/1995 |
| JP | 070327884 A | | 2/1999 |
| JP | 11-313786 | * | 11/1999 |
| JP | 2000-354569 | * | 12/2000 |
| JP | 2001-371 A | * | 1/2001 |
| KR | 2002095526 | * | 12/2002 |

* cited by examiner

*Primary Examiner*—Terrence R. Till
(74) *Attorney, Agent, or Firm*—Fleshner & Kim, LLP

(57) ABSTRACT

A suction head of a vacuum cleaner with a power brush is provided. In the suction head of the vacuum cleaner with the power brush, the power brush rotatively contacts objects to be cleaned and separates alien substances from the objects to be cleaned, to thus let the vacuum cleaner suck up the alien substances. The suction head of the vacuum cleaner includes a head case connected to a cleaner body and having a suction hole on the bottom, a power brush positioned in the head case, some part of which protrudes outward the head case through the suction hole, the power brush for removing alien substances, a supporting shaft fixed to the head case, the supporting shaft for supporting the power brush to be in a rotary motion, rotary/linear operating units installed between the supporting shaft and the power brush in the power brush, the rotary/linear operating units for rotatively operating and linearly reciprocating the power brush, and cooling fans for cooling the rotary/linear operating units by blowing an air outside the head case into the power brush while rotating the moment the power brush rotates. According to the suction head with the power brush, it is possible to reduce suction loss of the cleaner body, to thus improve a cleaning performance. It is possible to more effectively cool the operating device of the power brush.

30 Claims, 5 Drawing Sheets

SUCTION HEAD FOR VACUUM CLEANER

BACKGROUND OF THE INVENTION

1. Field of the Invention

The present invention relates to a suction head with a power brush that rotatively contacts objects to be cleaned and separates alien substances from the objects to be cleaned, and more particularly, to a suction head of a vacuum cleaner for cooling an operating device arranged in the power brush.

2. Description of the Background Art

In general, vacuum cleaners perform cleaning by collecting alien substances such as dust, which exist in objects to be cleaned, through strong suction force generated by the operation of a fan motor assembly.

Among such vacuum cleaners, there exists a vacuum cleaner with a power brush referred to as an agitator and positioned in a suction head, which rotatively contacts the objects to be cleaned and separates the alien substances from the objects to be cleaned, to thus let the vacuum cleaner easily suck up the alien substances from the objects to be cleaned. Accordingly, it is possible to improve a cleaning performance.

As shown in FIG. 1, the vacuum cleaner with the power brush in the suction head includes a cleaner body 100, in which a fan motor assembly for generating suction force so as to suck up the alien substances such as dust, which exist in the objects to be cleaned, is loaded, a connecting tube 105 longitudinally connected from the cleaner body 100 and operating as a path, through which the alien substances are sucked up into, and a suction head 110 connected to the end of the connecting tube 105 so that the alien substances can be sucked up into the suction head 110 in a state where the suction head 110 contacts the objects to be cleaned.

In particular, a power brush 121 rotatively contacting the objects to be cleaned, the power brush 20 for separating the alien substances existing in the objects to be cleaned from the objects is installed in the suction head 110.

FIGS. 2 and 3 are horizontal and vertical sectional views showing the suction head according to a conventional technology.

Referring to FIGS. 2 and 3, the suction head of the vacuum cleaner according to the conventional technology includes a head case 111, in which a suction hole 116 for sucking up the alien substances is formed on the bottom and a connecting part 113 is formed in the hind portion so that the cleaner body 100 of FIG. 1 can be connected, the power brush 121 rotatably installed in the head case 111, the power brush 121 for rotatively contacting the objects to be cleaned and removing the alien substances, and a rotary operating unit 131 arranged in the power brush 121, the rotary operating unit 131 for rotatively operating the power brush 121.

A first supporting shaft 112 and a second supporting shaft 114 are installed on both inner walls of the head case 111 so as to rotatably support both ends of the power brush 121.

A plurality of inlets 115 are formed in the head case 111, in which the first supporting shaft 112 is installed, so that outside air can be blown into the head case. The first supporting shaft 112 is formed to be a tube so that air can be blown thereinto.

The power brush 121 includes a cylindrical body part 122 and a brush 124 installed on the outer surface of the body part 122 to protrude along the direction of the radius of the body part 122.

The rotary operating device 131 includes an electric motor 133 whose rotary shaft is arranged along the direction of the first supporting shaft 112 in the end of the first supporting shaft 112 and a decelerator 135 having a predetermined deceleration ratio, whose one end is combined with the rotary shaft of the electric motor 133 and the other end is connected to the body part 122, to thus transmit the rotary power of the electric motor 133 to the body part 122.

The electric motor 133 and the decelerator 135 are formed to have an outer diameter smaller than the inner diameter of the body part 122 so that a channel, through which air flows, can be formed between the outer diameter surfaces of the electric motor 133 and the decelerator 135 and the inner diameter surface of the body part 122. A discharge hole 126 is formed behind the decelerator 135 in the body part so that air blown into the body part 122 through the inlets 115 can be discharged into the outside of the power brush 121.

A filter 128 is installed in the discharge hole 126 so that the alien substances such as blown from the outside can be filtered.

In the vacuum cleaner with the power brush according to the conventional technology, when power is applied to the fan motor assembly of the cleaner body 100, suction force is generated in the head case 111. The alien substances existing in the objects to be cleaned are sucked up into the suction hole 116 together with peripheral air.

When the power is applied to the electric motor 133 of the rotary operating device, the rotary power of the electric motor 133 is transmitted to the body part 122 through the decelerator 135. The body part 122 rotatively contacts the objects to be cleaned while rotating centering on the first and second supporting shafts 112 and 114, to thus remove the alien substances from the objects to be cleaned.

When the suction force for sucking up the alien substances is generated in the head case 111, the suction force operates in the power brush 121 through the discharge hole 126. The outside air is sucked up into the head case 111 through the inlets 115 of the head case 111 due to the suction force.

Thus sucked up air is blown into the body part 122 through the first supporting shaft 112, to thus cool the electric motor 133 and the decelerator 135, and is discharged into the inside of the head case 111 through a through hole 129 and the discharge hole 126. The air discharged into the inside of the head case 111 is sucked up into the cleaner body together with the sucked up air and the alien substances through the suction hole 116 of the head case 111.

However, in the suction head of the vacuum cleaner with the power brush according to the conventional technology, since the electric motor 133 is combined with one side of the first supporting shaft 112 and the decelerator 135 is combined with the output shaft of the electric motor 133, the structure of the suction head is complicated. Also, since the electric motor 133 and the decelerator 135 are hold in the housings, respectively, small areas of the electric motor 133 and the decelerator 135 contact an air. Accordingly, the rotary operating device cannot be effectively cooled.

Since the channel, through which the air passes, is formed between the internal diameter of the body part 122 of the power brush 121 and the housings of the electric motor 133 and the decelerator 135, it is significantly restricted to appropriately design the size of the electric motor 133 and the air flow channel.

Since the outside air is sucked up into the power brush 121 using the suction force generated in the head case 111 by the fan motor assembly of the cleaner body 100, to thus cool the rotary operating device, suction loss of the fan motor assembly of the cleaner body occurs, to thus deteriorate a cleaning performance.

SUMMARY OF THE INVENTION

Therefore, an object of the present invention is to provide a suction head of a vacuum cleaner, which is capable of effectively cooling an operating device arranged in a power brush and of reducing suction loss of the vacuum cleaner, to thus improve a cleaning performance.

To achieve these and other advantages and in accordance with the purpose of the present invention, as embodied and broadly described herein, there is provided a suction head of a vacuum cleaner, comprising a head case connected to a cleaner body and having a suction hole on the bottom, a power brush positioned in the head case, some part of which protrudes outward the head case through the suction hole, the power brush for removing alien substances, a supporting shaft fixed to the head case, the supporting shaft for supporting the power brush to be in a rotary motion, rotary/linear operating means installed between the supporting shaft and the power brush in the power brush, the rotary/linear operating means for rotatively operating and linearly reciprocating the power brush, and cooling fans for cooling the rotary/linear operating means by blowing an air outside the head case into the power brush while rotating the moment the power brush rotates.

The suction head of the vacuum cleaner further comprises shielding means for separating a channel leading to the inside of the power brush from a channel leading to the suction hole of the head case. The cylindrical shielding means is installed between a suction hole of the head case and apertures formed on both surfaces of the power brush and is connected to the power brush through a bearing so as to be in a relative motion.

The shielding means is a bellows connected between the head case and a body part.

The apertures connected to the outside of the head case are formed on both surfaces of the power brush and the cooling fans are installed at least one side of the apertures of the power brush.

The outer ring of the cooling fan is fixed to the power brush in a state where the cooling fan is relatively and rotatably supported by the supporting shaft.

The cooling fan comprises a hub relatively and rotatably supported by the supporting shaft, the outer ring combined with the power brush, and blades connected between the hub and the outer ring, the blades for generating flow force.

According to another embodiment of the present invention, both side surfaces of the power brush are opened and the cooling fans are installed in the inner center of the power brush.

According to another embodiment of the present invention, the cooling fans are formed on both surfaces of the power brush by processing the radial blades.

There is provided another suction head of a vacuum cleaner, comprising a head case connected to a cleaner body and having a suction hole on the bottom, a power brush positioned in the head case, some part of which protrudes outward the head case through the suction hole, the power brush for removing alien substances, a supporting shaft fixed to the head case, the supporting shaft for supporting the power brush to be in a rotary motion, rotary operating means installed between the supporting shaft and the power brush in the power brush, the rotary operating means for rotatively operating the power brush, and cooling fans for cooling the rotary operating means by blowing an air outside the head case into the power brush while rotating the moment the power brush rotates.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An embodiment of a suction head of a vacuum cleaner according to the present invention will now be described with reference to the attached drawings.

Figure 1:
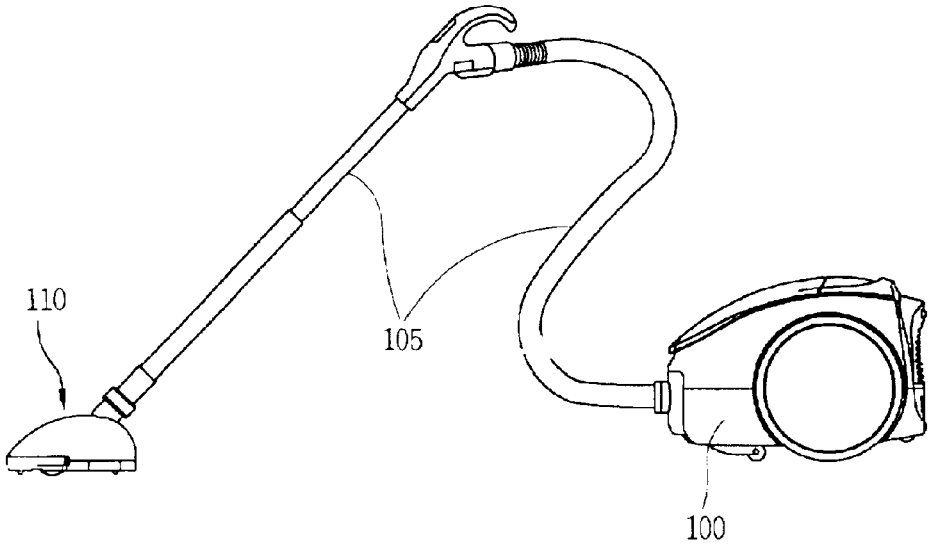
FIG. 1 CONVENTIONAL ART
FIG. 1 is a side view showing a vacuum cleaner according to a conventional technology.
Figure 2:
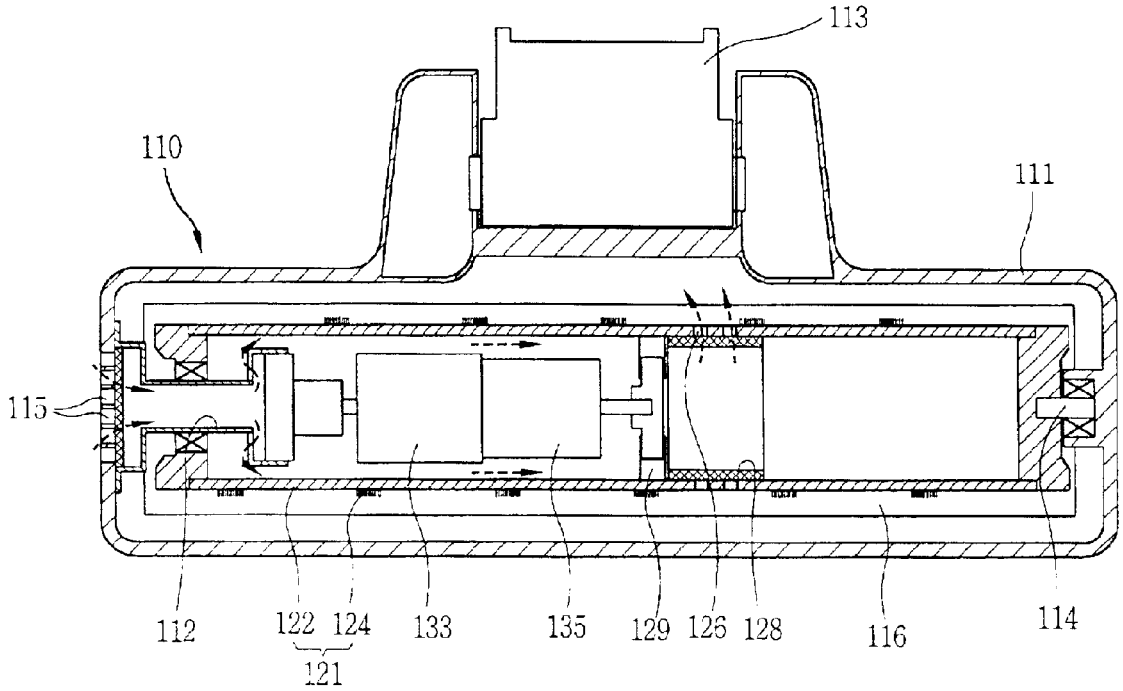
FIG. 2 CONVENTIONAL ART
FIG. 2 is a horizontal sectional view showing a suction head of the vacuum cleaner according to the conventional technology.
Figure 3:
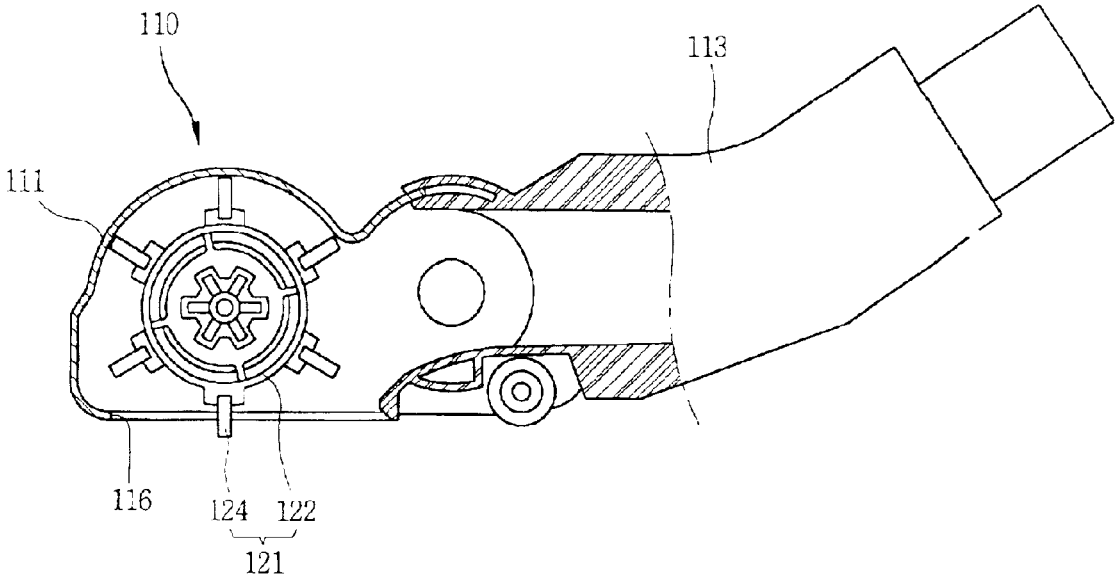
FIG. 3 CONVENTIONAL ART
FIG. 3 is a vertical sectional view showing the suction head of the vacuum cleaner according to the conventional technology.
Figure 4A:
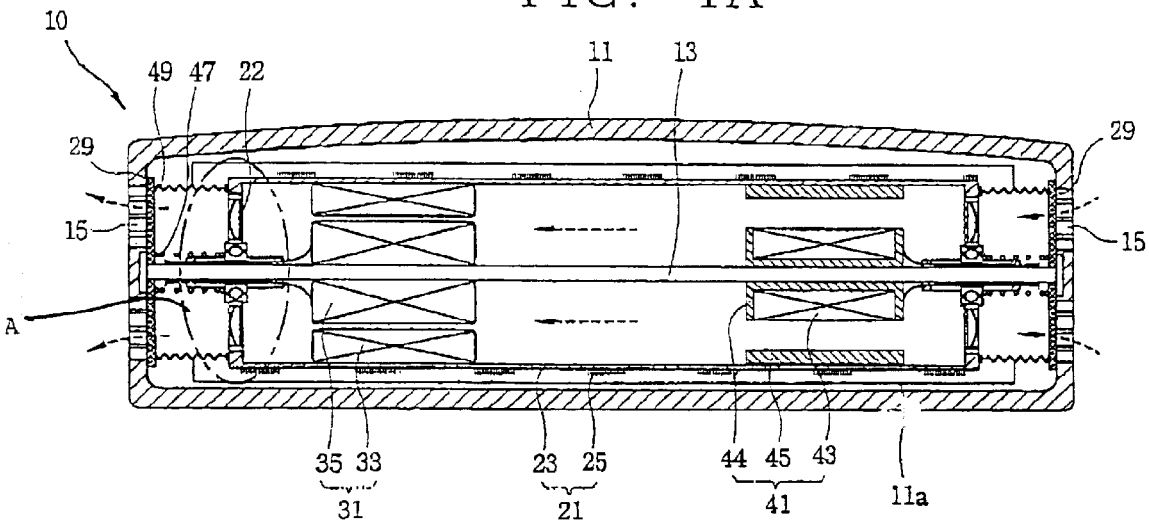
FIG. 4A is a horizontal sectional view showing a suction head of a vacuum cleaner with a power brush cooling device according to an embodiment of the present invention.
Figure 4B:
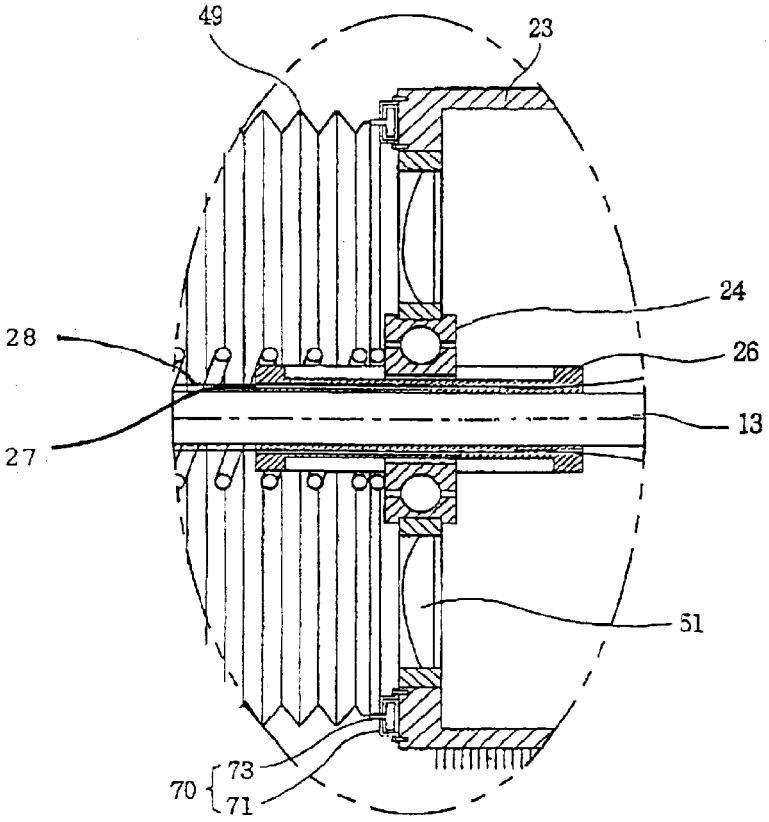
FIG. 4B is an enlarged view of area "A" of FIG. 4A.
Figure 5:
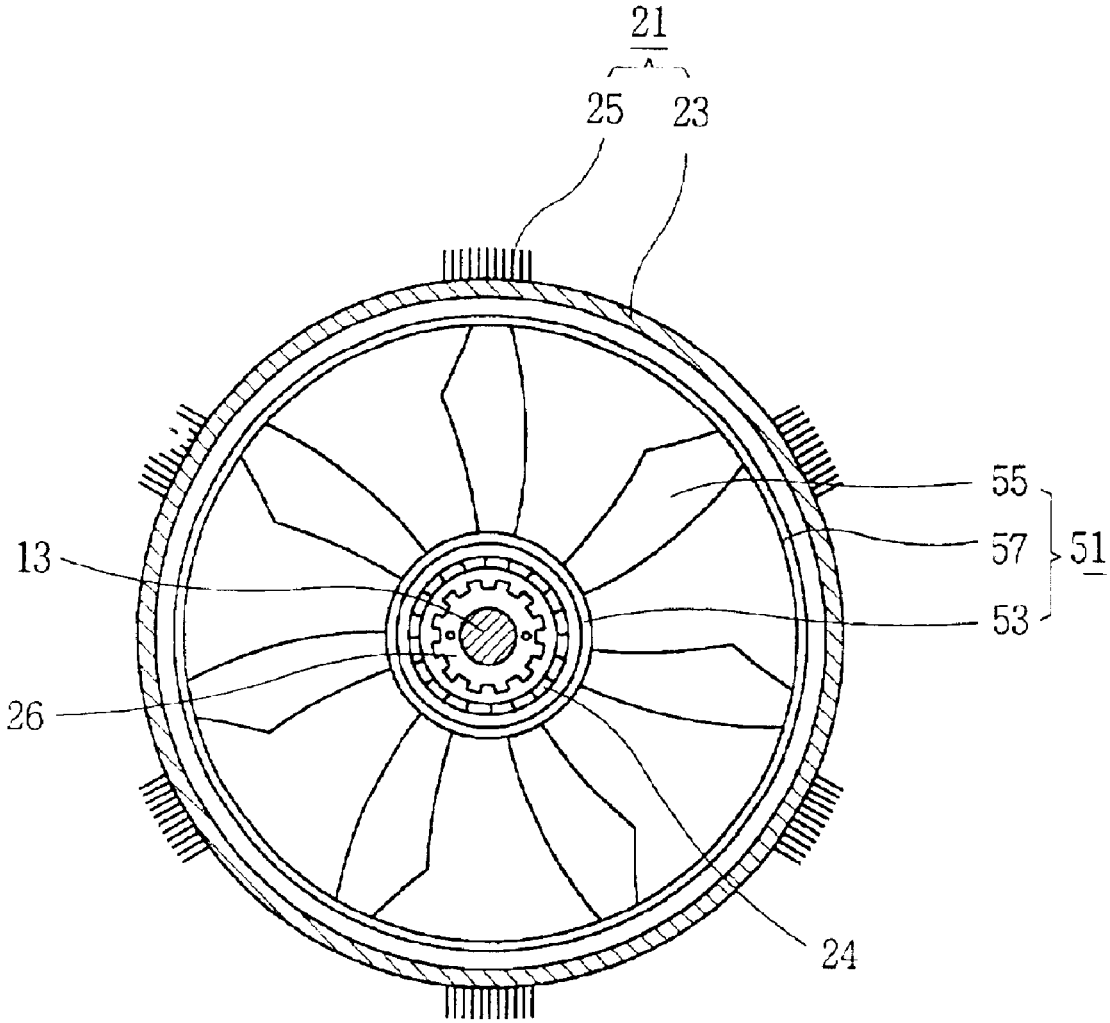
FIG. 5 is a front view showing a cooling fan according to an embodiment of the present invention.

FIG. 4A is a horizontal sectional view showing a suction head of a vacuum cleaner according to an embodiment of the present invention. FIG. 4B is an enlarged view of area "A" of FIG. 4A. FIG. 5 is an enlarged front view showing the cooling fan of FIG. 4.

A suction head 10 of a vacuum cleaner according to an embodiment of the present invention includes a head case 11, in which a suction hole 11*a* is formed on the bottom so as to suck up alien substances existing in objects to be cleaned and a peripheral air, a power brush 21, some part of which is exposed to the outside through the suction hole 11*a* in the head case 11, the power brush 21 contacting the objects to be cleaned while being in rotary and linear motions, to thus remove the alien substances, a rotary operating device 31 installed in the power brush 21, the rotary operating device 31 for rotatively operating the power brush 21, a linear operating device 41 installed in the power brush 21, the linear driving device 41 for axially and linearly reciprocating the power brush 21, and cooling fans 51 installed on both surfaces of the power brush 21, the cooling fans 51 for blowing the air from the outside of the head case 11 and cooling the rotary operating device 31 and the linear operating device 41.

Main parts forming the suction head 10 will now be described in detail.

A supporting shaft 13 for supporting the power brush 21 so that the power brush 21 can be in the rotary and linear motions is installed in the head case 11. Both ends of the supporting shaft 13 are fixed to both inner walls of the head case 11.

Through holes 15 are formed on the both inner walls of the head case 11 so that the air can pass through. Filters 29 are installed around the through holes 15 so as to prevent the alien substances from being blown into.

The power brush 21 includes a cylindrical body part 23, in which a holding space is formed and inside and apertures 22 are formed on both surfaces, and a brush 25 protruding above the outer circumference of the body part 23 along the direction of the body part 23.

Bearings 24 for rotatably supporting the body part 23 are installed between both walls of the body part 23 and the supporting shaft 13. Guide bushes 26 for supporting the bearings 24 are installed between the bearings 24 and the supporting shaft 13 so that the bearings 24 and the power brush can axially and linearly move.

A hole 27, through which a power cable 28 passes, is formed in the guide bush 26 so as to supply power to the rotary operating device 31 and the linear operating device 41.

The linear operating device 41 includes a solenoid coil 43 wound around a bobbin 44 fixed to the supporting shaft 13 and a moving core 45 installed on the inner circumference of the body part 23 so as to correspond to the solenoid coil 43, the moving core 45 for generating the linear mobility of the power brush 21.

A pair of springs 47 for providing elasticity so that the axially and linearly moved power brush 21 is returned to an initial position by a mutual operation between the solenoid coil 43 and the moving core 45 and that the power brush 21 is continuously in a reciprocating motion are installed on both sides of the body part 23.

The rotary operating device 31 includes a stator 35 fixed to the supporting shaft 13 and a rotor 33 fixed to the inner circumference of the body part 23, the rotor 33 for generating the rotary operating power of the power brush 21 by a mutual operation between the rotor 33 and the stator 35.

Apertures 22 are formed on both walls of the body part 23. The cooling fans 51 are installed in the apertures 22 so that the outside air of the body part 23 can be blown into and the inside air can be discharged when the body part 23 rotates.

That is, the cooling fans 51 are fixed to between the body part 23 and the bearings 24 in the region of the apertures 22 so that the cooling fans 51 simultaneously rotate.

The cooling fan 51 includes a hub 53 fixed around the bearing 24, an outer ring 57 fixed to the body part 23, and a blade 55 radially connected between the hub 53 and the outer ring 57, the blade 55 for forcibly blowing the air.

The blade 55 is formed in the cooling fans 51 installed on both sides of the body part 23 so as to suck up the outside air on one side (the right side in the drawing) of the body part 23 and to discharge the inside air of the body part on the other side (the left side in the drawing) of the body part 23.

The hub 53 of the cooling fan 51 is combined with the outer race of the bearing 24 for supporting the rotation of the body part 23 by press fitting the hub 53 to the outer race of the bearing 24. The inner race of the bearing 24 is combined with the guide bush 26 integrally combined with the supporting shaft 13 so that the inner race of the bearing 24 can slide the guide bush 26.

A bellows 49 that is an elastic tube shaped joint member is connected between the head case 11 and the body part 23. The bellows 49 lets the power brush 21 axially move and prevents the air flowing between the through hole 15 of the head case 11 and the aperture 22 of the body part 23 from being blown into the head case 11. In particular, the bellows 49 prevents the suction force from deteriorating when the alien substances existing in the objects to be cleaned are sucked up through the suction hole 11*a* of the suction case 11.

One side of the bellows 49 is fixed to the head case. The other end of the bellows 49 is fixed to the body part through a bearing so that the bellows 49 can relatively moves.

The bearing 70 includes a ring-shaped bearing supporter 71 fixed to the side surface of the body part 23 and a bearing slider 73 that is combined with the bellows 49 in a state where the bearing slider 73 is inserted into the bearing supporter 71 not to drift away and is in a relative motion while sliding the bearing supporter 71 in a rotary direction.

The external diameter of the bellows 49 is preferably formed to be smaller than the external diameter of the body part 23.

The operation of the suction head of the vacuum cleaner according to an embodiment of the present invention will now be described.

When the power is applied to the fan motor assembly of the cleaner body, to thus operate the fan motor assembly, the suction force is generated in the head case 11 positioned near the objects to be cleaned. At this time, the alien substances existing around the objects to be cleaned are sucked up through the suction hole of the head case 11.

When the power is applied to the rotary operating device 31, a rotor 33 rotates centering on the supporting shaft 13. At this time, the brush 25 rotatively contacts the objects to be cleaned, to thus separate the alien substances from the objects to be cleaned and to thus let the alien substances sucked up into the cleaner body.

When the power is applied to the solenoid coil 43 of the linear operating device 41, a magnetic field is formed around the solenoid coil 43. The moving core 45 moves to a direction, in which magnetic resistance becomes smaller, that is, to one side along the direction of the supporting shaft 13. At this time, the spring 47 accumulates the elasticity while being compressed and returns the body part 23 to the initial position when the power is not applied to the solenoid coil 43.

When the power applied to the solenoid coil 43 is repeatedly turned on and off in a state where the power is continuously applied to the stator 35, the body part 23 are in the rotary and linear reciprocating motions. Accordingly, it is possible to more effectively remove the alien substances attached to the objects to be cleaned.

When the body part 23 of the power brush 21 rotates, the cooling fan 51 rotates at the same time, to thus blow the air from the linear operating device 41 whose temperature is relatively low to the rotary operating device 31 whose temperature is relatively high and to thus cool the linear operating device 41 and the rotary operating device 31.

At this time, the bellows 49 contracts according to the linear motion of the power brush 21, to thus intercept the air blown into through the suction hole 11*a* of the head case 11 from the air for cooling the power brush 21.

Figure 6:
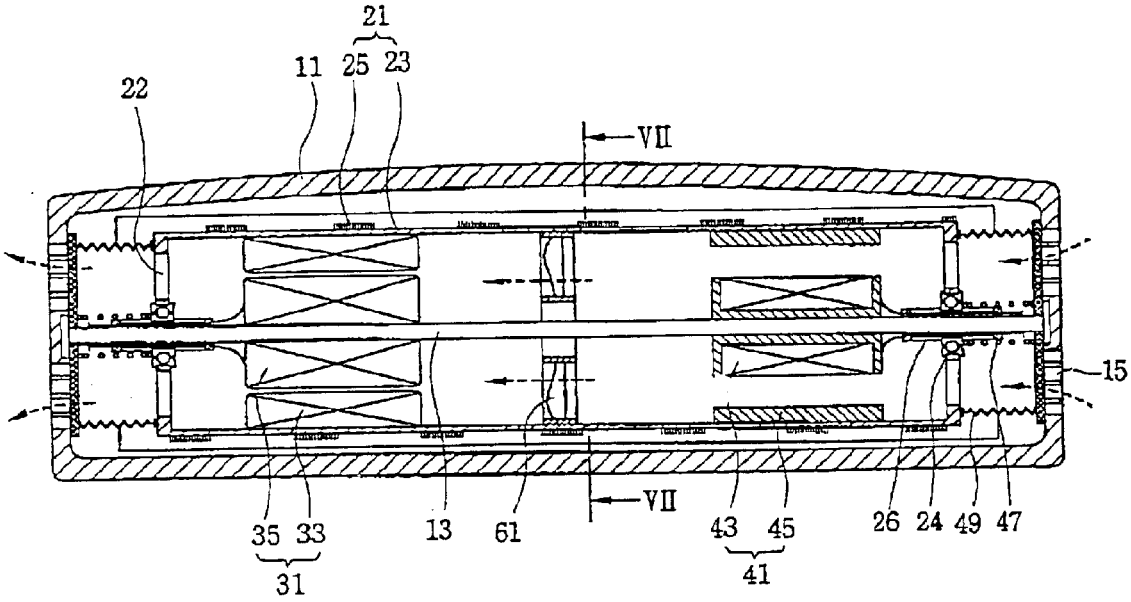
FIG. 6 is a horizontal sectional view showing a suction head of a vacuum cleaner with a power brush cooling device according to another embodiment of the present invention.
Figure 7:
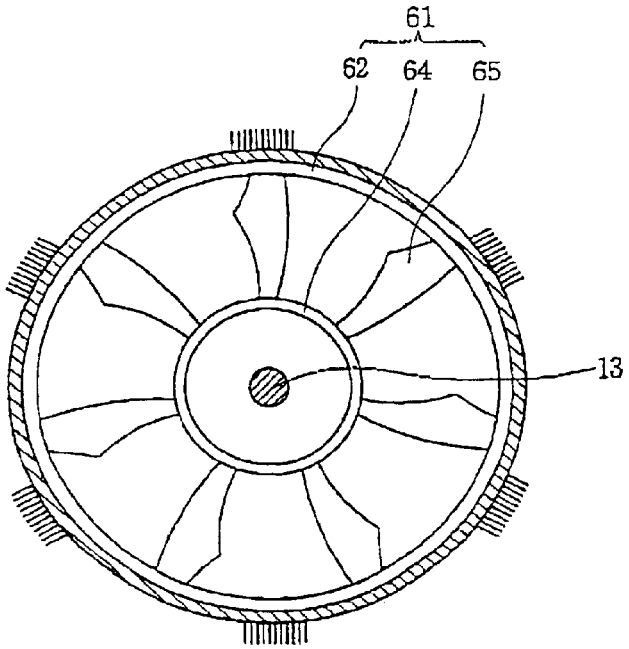
FIG. 7 is a sectional view taken along the ling VII—VII of FIG. 6.

FIG. 6 is a horizontal sectional view of a suction head of a vacuum cleaner according to another embodiment of the present invention. FIG. 7 is a sectional view taken along the line VII—VII of FIG. 6. The same reference numerals are provided to the same elements as the elements of the above-mentioned embodiment, and thus their description will be omitted.

A suction head according to another embodiment of the present invention includes a head case 11, a supporting shaft 13 longitudinally installed inside the head case 11, a power brush 21 combined with the supporting shaft 13 to be in the relative motion, the power brush 21 contacting the objects to be cleaned, to thus remove the alien substances, the rotary operating device 31 and the linear operating device 41 installed in the power brush 21, the rotary operating device 31 and the linear operating device 41 for rotatively and linearly moving the power brush 21, and a cooling fan 61 installed in the power brush 21, the cooling fan 61 for forcibly blowing the air, to thus cool the rotary operating device 31 and the linear operating device 41.

The cooling fan 61 is fixed to the power brush 21 between the rotary operating device 31 and the linear operating device 41. Blades 65 are formed so that the air can be blown from the linear operating device 41 whose temperature is relatively low to the rotary operating device 31.

The cooling fan 61 includes an outer ring 62 integrally and rotatably fixed to the inner circumference of the body part 23 by press fitting the outer ring 62 to the inner circumference of the body part 23, a hub 64 formed to have a radius smaller than the radius of the outer ring 62, and the plurality of blades 65 radially connected between the outer ring 62 and the hub 64, the blades 65 for generating air flow force.

Both surfaces of the body part 23 of the power brush 21 are supported by the supporting shaft 13 through the bearings 24 to be in the rotary and linear motions in a state where the plurality of apertures 22 are formed.

In the suction head of the vacuum cleaner according to another embodiment of the present invention, when the rotary brush 21 rotates centering on the supporting shaft 13, the cooling fan 61 integrally rotates together with the body part 23, to thus let the air flow from the linear operating device 41 whose temperature is relatively low to the rotary operating device 31 whose temperature is relatively high. Accordingly, it is possible to effectively cool the linear operating device 41 and the rotary operating device 31.

In the above-mentioned embodiments, the cooling fans are additional parts and can be assembled to the body part. However, according to a design condition, the cooling device can be formed by processing both surfaces of the body part, to thus integrate the blades with the body part.

In the suction head of the vacuum cleaner according to the present invention, since the outside air is blown into in a state where the inner region of the head case is intercepted from the inner region of the power brush, to thus cool the operating device in the power brush, it is possible to reduce the suction loss of the cleaner body, to thus improve the cleaning performance, and to more effectively cool the operating device of the power brush.

What is claimed is:

1. A suction head of a vacuum cleaner, comprising:

a head case connected to a cleaner body and having a suction hole on a bottom surface thereof;

a power brush positioned in the head case, a portion of which protrudes outward from the head case through the suction hole, the power brush for removing alien substances;

a supporting shaft fixed to the head case, the supporting shaft for supporting a rotary motion of the power brush;

rotary/linear operating means installed within the power brush between the supporting shaft and an inner portion of the power brush, the rotary/linear operating means for rotatively operating and linearly reciprocating the power brush; and cooling fans for cooling the rotary/linear operating means by blowing air from outside the head case into the power brush by rotating as the power brush rotates.

2. The suction head of claim 1, further comprising a shielding means for separating a channel leading to an inside of the power brush from a channel leading to the suction hole of the head case.

3. The suction head of claim 2, wherein the shielding means is installed between a through hole of the head case and apertures formed on end surfaces of the power brush, and the shielding means is connected to the power brush through a bearing so as to maintain a relative motion therewith.

4. The suction head of claim 2, wherein the shielding means is a bellows connected between the head case and a body portion of the power brush.

5. The suction head of claim 1, wherein apertures connected to an outside of the head case are formed on both end portions of the power brush, and the cooling fans are installed in at least one of the apertures of the power brush.

6. The suction head of claim 5, wherein an outer ring of the cooling fan is fixed to the power brush, and wherein the cooling fan is relatively and rotatably supported by the supporting shaft.

7. The suction head of claim 5, wherein the cooling fan comprises a hub relatively and rotatably supported by the supporting shaft, the outer ring combined with the power brush, and blades radially connected between the hub and the outer ring, the blades for generating a flow force.

8. The suction head of claim 1, wherein the cooling fans are formed on both surfaces of the power brush by processing the radial blades.

9. The suction head of claim 1, wherein a filter is installed inside a through hole of the head case so as to prevent alien substances from being blown into the head case.

10. A suction head of a vacuum cleaner, comprising:

a head case connected to a cleaner body and having a suction hole on a bottom surface thereof;

a power brush positioned in the head case, a portion of which protrudes outward from the head case through the suction hole, the power brush for removing alien substances;

a supporting shaft fixed to the head case, the supporting shaft for supporting a rotary motion of the power brush;

rotary operating means installed within the power brush between the supporting shaft and an inner portion of the power brush, the rotary operating means for rotatively operating the power brush;

cooling fans for cooling the rotary operating means by blowing air from outside the head case into the power brush by rotating as the power brush rotates; and a shielding means for separating a channel leading to an inside of the power brush from a channel leading to the suction hole of the head case.

11. The suction head of claim 10, wherein the shielding means is installed between a through hole of the head case and apertures formed on end surfaces of the power brush, and wherein the shielding means is connected to the power brush through a bearing so as to maintain a relative motion therewith.

12. The suction head of claim 10, wherein apertures connected to an outside of the head case are formed on both end portions of the power brush, and the cooling fans are installed in at least one of the apertures of the power brush.

13. The suction head of claim 12, wherein an outer ring of the cooling fan is fixed to the power brush, and wherein the cooling fan is relatively and rotatably supported by the supporting shaft.

14. The suction head of claim 13, wherein the cooling fan comprises a hub relatively and rotatably supported by the supporting shaft, the outer ring combined with the power brush, and blades radially connected between the hub and the outer ring, the blades for generating a flow force.

15. The suction head of claim 10, wherein both end portions of the power brush are opened and the cooling fans are installed in an inner center portion of the power brush.

16. A suction head for a vacuum cleaner, comprising:

a case configured to be connected to a cleaner body and having a suction hole on a surface thereof;

a power brush configured to be positioned in the case such that a portion of the power brush protrudes through the suction hole;

a supporting mechanism configured to be fixed to the case to support rotary and linear motion of the power brush;

a rotary/linear operating device configured to rotate and to linearly reciprocate the power brush; and cooling fans configured to cool the rotary/linear operating device.

17. The suction head of claim 16, wherein the cooling fans are further configured to rotate as the power brush rotates, and to blow air from outside the case onto the power brush.

18. The suction head of claim 16, wherein the rotary/linear operating device is configured to be installed within the power brush, in an area between the supporting mechanism and an inner portion of the power brush.

19. The suction head of claim 16, further comprising a shielding device configured to separate a channel leading to an inside of the power brush from a channel leading to the suction hole of the case.

20. The suction head of claim 19, further comprising apertures formed on end portions of the power brush, wherein the shielding device is configured to be installed between a through hole of the case and the apertures.

21. The suction head of claim 20, wherein the shielding device comprises a bellows provided between the case and a body portion of the power brush.

22. The suction head of claim 20, wherein the cooling fans are configured to be installed in at least one of the apertures of the power brush.

23. The suction head of claim 16, wherein each cooling fan comprises a hub rotatively installed on the supporting shaft, an outer ring in contact with the power brush, and blades extending radially from the hub to the outer ring and configured to generate an air flow.

24. A suction head for a vacuum cleaner, comprising:

a case configured to be connected to a cleaner body and having a suction hole on a surface thereof;

a power brush configured to be positioned in the case such that a portion of the power brush protrudes through the suction hole;

a supporting mechanism configured to be fixed to the case, and to support a rotary motion of the power brush;

a rotary operating device configured to rotate the power brush;

cooling fans configured to cool the rotary operating device; and a shielding device configured to separate a channel leading to an inside of the power brush from a channel leading to the suction hole of the case.

25. The suction head of claim 24, wherein the cooling fans are configured to rotate as the power brush rotates, and to blow air from outside the case into the case.

26. The suction head of claim 24, wherein the rotary operating device is configured to be installed within the power brush, in an area between the supporting mechanism and an inner portion of the power brush.

27. The suction head of claim 24, further comprising apertures formed on end surfaces of the power brush, wherein the shielding device is configured to be installed between a through hole of the case and the apertures.

28. The suction head of claim 27, wherein the cooling fans are configured to be installed in at least one of the apertures of the power brush.

29. The suction head of claim 24, wherein each cooling fan comprises a hub rotatively installed on the supporting shaft, an outer ring in contact with the power brush, and blades extending radially from the hub to the outer ring and configured to generate an air flow.

30. The suction head of claim 24, wherein both end portions of the power brush are open, and wherein the cooling fans are installed in an inner center portion of the power brush.

* * * * *